US007225888B1

(12) United States Patent
Van Steenwyk et al.

(10) Patent No.: US 7,225,888 B1
(45) Date of Patent: Jun. 5, 2007

(54) HYDRAULIC FLUID COUPLING

(75) Inventors: Donald H. Van Steenwyk, San Marino, CA (US); Raymond W. Teys, Pismo Beach, CA (US); James R. Higginbotham, The Woodlands, TX (US)

(73) Assignee: Scientific Drilling International, Houston, TX (US)

( * ) Notice: Subject to any disclaimer, the term of this patent is extended or adjusted under 35 U.S.C. 154(b) by 237 days.

(21) Appl. No.: 10/974,592

(22) Filed: Oct. 26, 2004

(51) Int. Cl.
*E21B 7/06* (2006.01)

(52) U.S. Cl. ..... 175/61; 175/73

(58) Field of Classification Search ..... 175/61, 175/73, 76; 285/121.1, 121.3, 121.6, 123.15
See application file for complete search history.

(56) References Cited

U.S. PATENT DOCUMENTS 4,302,033 A 11/1981 Evans et al.
4,449,738 A 5/1984 Hotger
5,289,846 A 3/1994 Elias et al.
5,547,031 A * 8/1996 Warren et al. ..... 175/61
5,816,273 A 10/1998 Milocco et al.
6,286,541 B1 9/2001 Musschoot et al.
6,402,507 B1 6/2002 Boettger

* cited by examiner

*Primary Examiner*—William P. Neuder
(74) *Attorney, Agent, or Firm*—William W. Haefliger

(57) ABSTRACT

For use in a wellbore containing a rotary drill string and a drill bit, the combination comprising, a rotary mandrel containing a through opening to pass drilling fluid downwardly from the interior of the drill string, and toward the bit, a non-rotary housing extending about the mandrel, a plenum or plenums in the housing in communication with the interior of the mandrel through an opening to receive fluid pressure used to actuate means associated with drilling activity in the well, and a controlled fluid gap proximate the housing, to slowly leak drilling fluid to the annulus outside the string.

25 Claims, 6 Drawing Sheets

Figure 1:
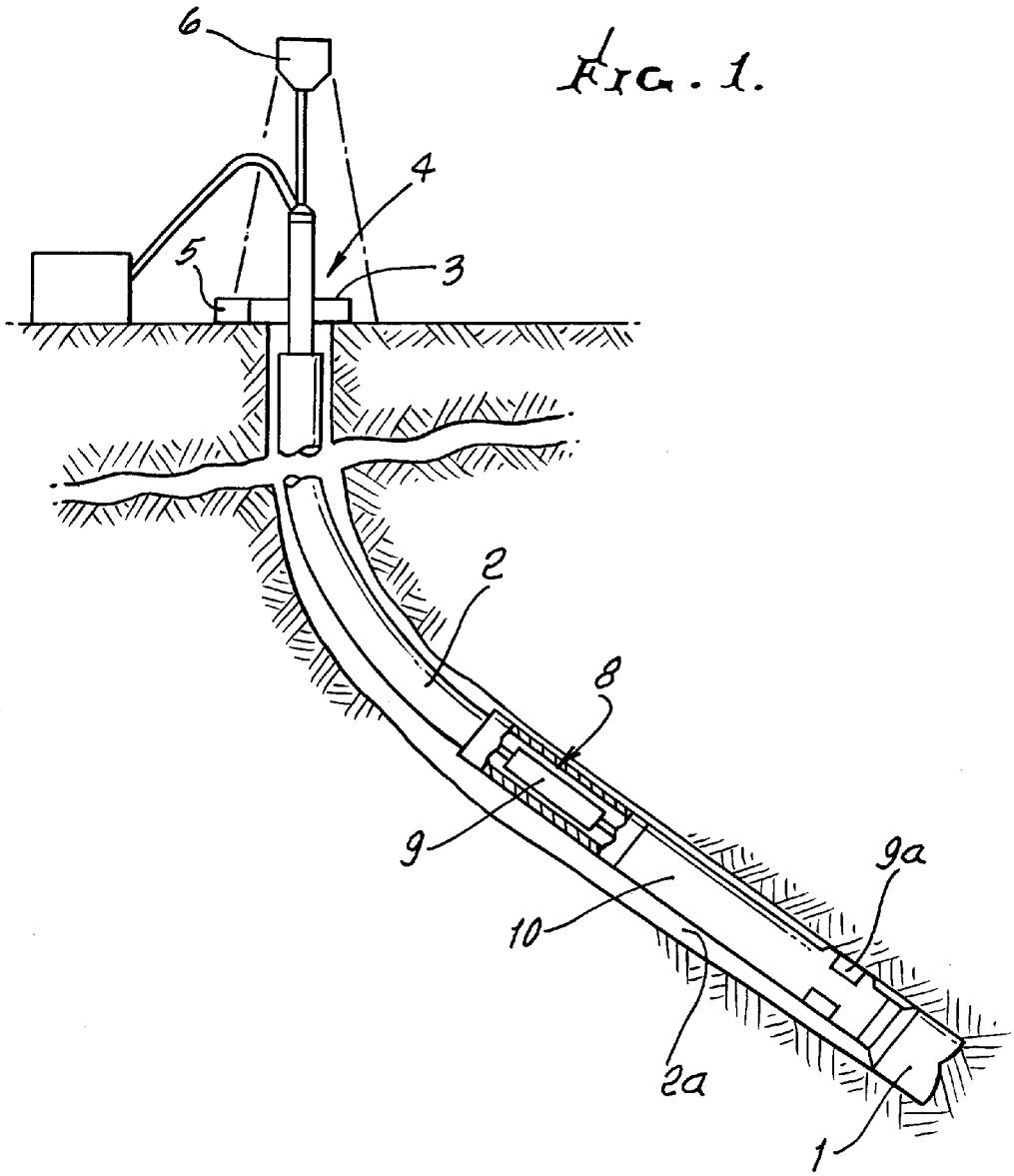

131
132
130
CONTROL ELECTRONICS
161
CONTROL SIGNALS
140
134
126
5
160
134d
134a
134c
134b
135
127
5
160
135d
135a
135c
135b
136
128
5
160
136d
136a
136c
136b
137
129
5
160
137a
137d
137c
137b
PRESSURE RESERVOIR
119
F
125
NON-ROTATING
18a
11
12
124
ROTATING
SLIP GAP

HYDRAULIC FLUID COUPLING

BACKGROUND OF THE INVENTION

This invention generally relates to apparatus to conduct drilling fluids in a downhole drilling apparatus between first rotating elements and second other elements that are non-rotating or rotating at a different angular rate than the first rotating elements. One aspect of the invention concerns controlled sealing provided between juxtaposed surfaces which are relatively movable. In this regard, the relative movement is rotation about a longitudinal axis common to both sets of elements.

An example of such usage is in a steerable rotary drilling apparatus. In such an apparatus, a drill string extending from the surface of the earth to a drill bit at the bottom of a borehole is continuously rotated. Various apparatus or means for steering the direction of drilling advance may be provided near the drill bit, and generally outside the drill string. Such apparatus may provide either a sideways force on the bit or it may actually point the bit toward the desired direction. Examples of such apparatus are shown in U.S. Pat. Nos. 5,035,872, 5,113,953, 5,265,682, 5,520,255, 5,617,926 and 6,092,610. Such apparatus is generally rotationally stabilized either to a zero angular rate or an angular rate that is much less than the drill string angular rotation rate. Various means are used to provide such force or direction control. Both electrical and hydraulic means may be used. If a hydraulic means is used, it is based on pressure from the drilling fluids supplied via the interior of the drill string, and a rotary joint means is needed for conducting high-pressure drilling fluid from the interior of the rotating drill string to the direction control apparatus outside of the drill string. None of the examples of steerable rotary drilling disclosed in such referenced patents provide a suitable solution to this requirement; and none of such examples provide the unusually advantageous apparatus construction, modes of operation and results as are disclosed herein.

SUMMARY OF THE INVENTION

It is a major object of the invention to provide improved apparatus meeting the above need. It is an objective of the present invention to provide a highly effective, controlled leakage rotary joint for drilling fluids of high reliability and long operating life.

Basically, the invention is adapted for use in a well bore containing a rotary drill string and a drill bit, the combination comprising:

a) a rotary mandrel containing a through opening to pass drilling fluid downwardly from the interior of the drill string, and toward the bit, b) a non-rotary housing extending about the mandrel, c) a plenum in the housing in communication with the interior of the mandrel through opening to receive and store fluid pressure used to actuate means associated with drilling activity in the well, d) and a controlled fluid leaking gap proximate the housing.

As will be seen, there are side passages in the mandrel and in the housing to pass said fluid pressure from the mandrel through opening to said plenum.

Another object is to provide a first sleeve received in the housing and defining at least part of said plenum, outwardly of said mandrel, said sleeve being non-rotating. A second and floating sleeve is typically received in the housing and attached to the mandrel to rotate therewith, said first sleeve extending about at least part of the second sleeve, and a third and intermediate sleeve located between the first and second sleeves, the second and third sleeves having flexible inter-connection allowing relative movement therebetween about an axis normal to the longitudinal axis defined by the housing, and there being openings in the second and third sleeves to pass fluid pressure from the mandrel to said plenum. The flexible inter-connection may be provided by O-rings at opposite ends of the second sleeve and engaging the second and third sleeves.

Yet another object is to provide a radial gap between the first and third sleeves to pass fluid leakage from the plenum, and having a size controlled by floating movement of the second sleeve.

It will be understood that the first sleeve may be part of the housing, and the second sleeve may be part of the mandrel.

Additional objects include supporting of the mandrel and housing by the drill string, the drill bit connected to rotate with the mandrel.

As will be seen, the invention provides a rotary fluid joint apparatus for conducting fluid from the interior of a rotating element to an exterior non-rotating or slowly-rotating element comprising an interior floating element for connection to the interior rotating element, an intermediate element flexibly-connected to the interior floating element constrained to rotate in a bore of an outer element, a flexible coupling mechanism for connecting the intermediate element to said floating element, the outer element connected to said exterior non-rotating or slowly-rotating element and openings provided in the floating element, the intermediate element and the outer element to permit outward flow of fluid or fluid produced from the interior of the rotating element to the exterior non-rotating or slowly-rotating element.

These and other objects and advantages of the invention, as well as the details of an illustrative embodiment, will be more fully understood from the following specification and drawings, in which:

DRAWING DESCRIPTION

Figure 2:
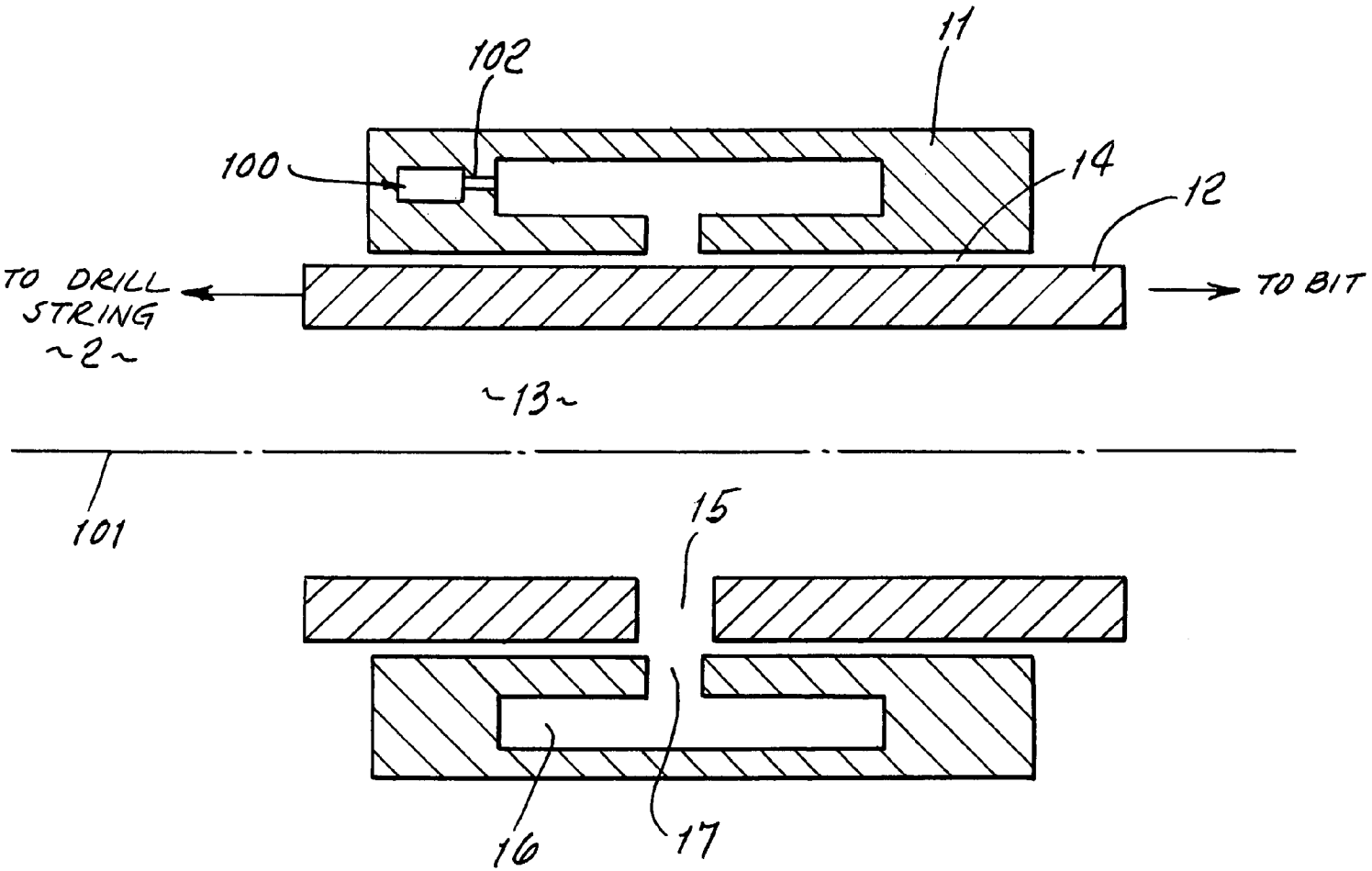
Figure 3A:
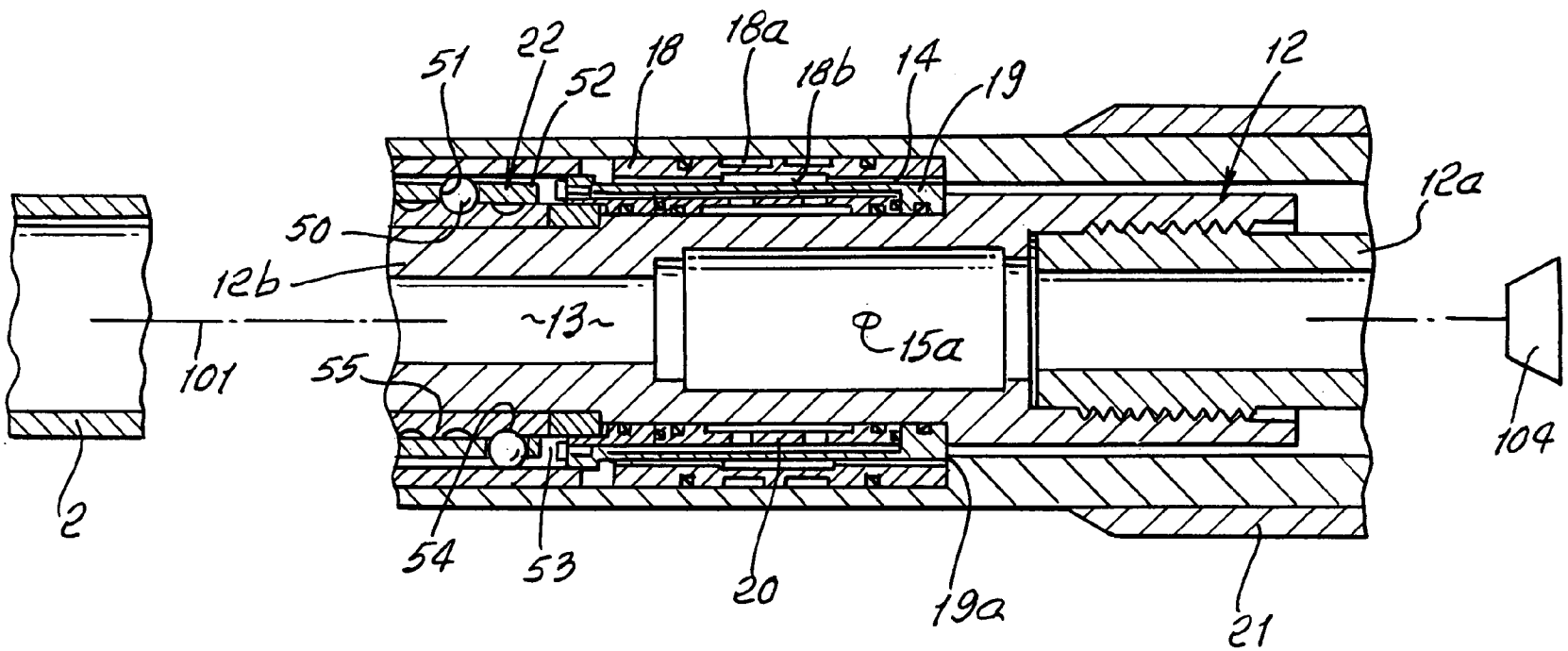
Figure 3A:
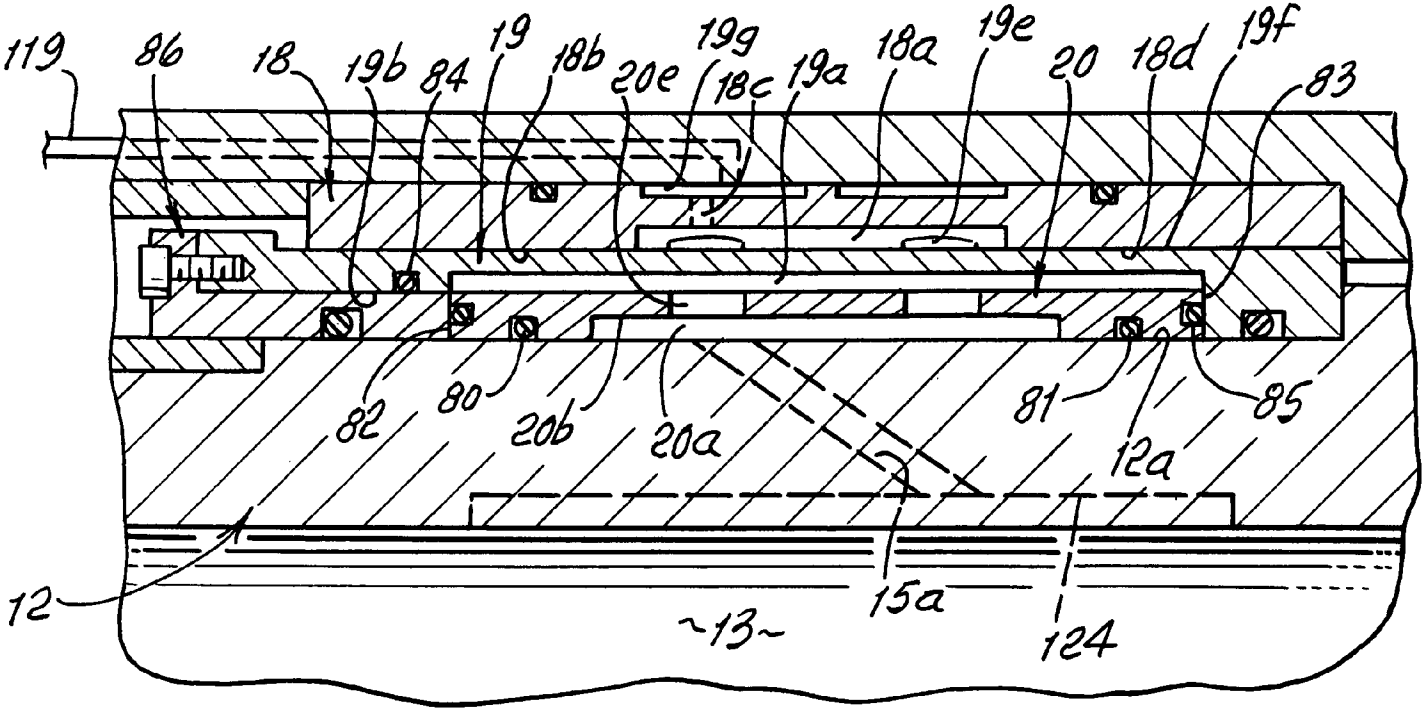

FIG. 1 shows the cross-section of a borehole containing a steerable rotary drilling mechanism and showing a typical desired path change for such a borehole;

FIG. 2 schematically shows a longitudinal cross-section of a portion of a steerable rotary drilling apparatus;

FIG. 3*a* shows a longitudinal cross-section of the rotary joint for drilling fluid of the present invention with the central rotating mandrel in place;

FIG. 3*aa* shows 3*a* in greater detail; and

Figure 3B:
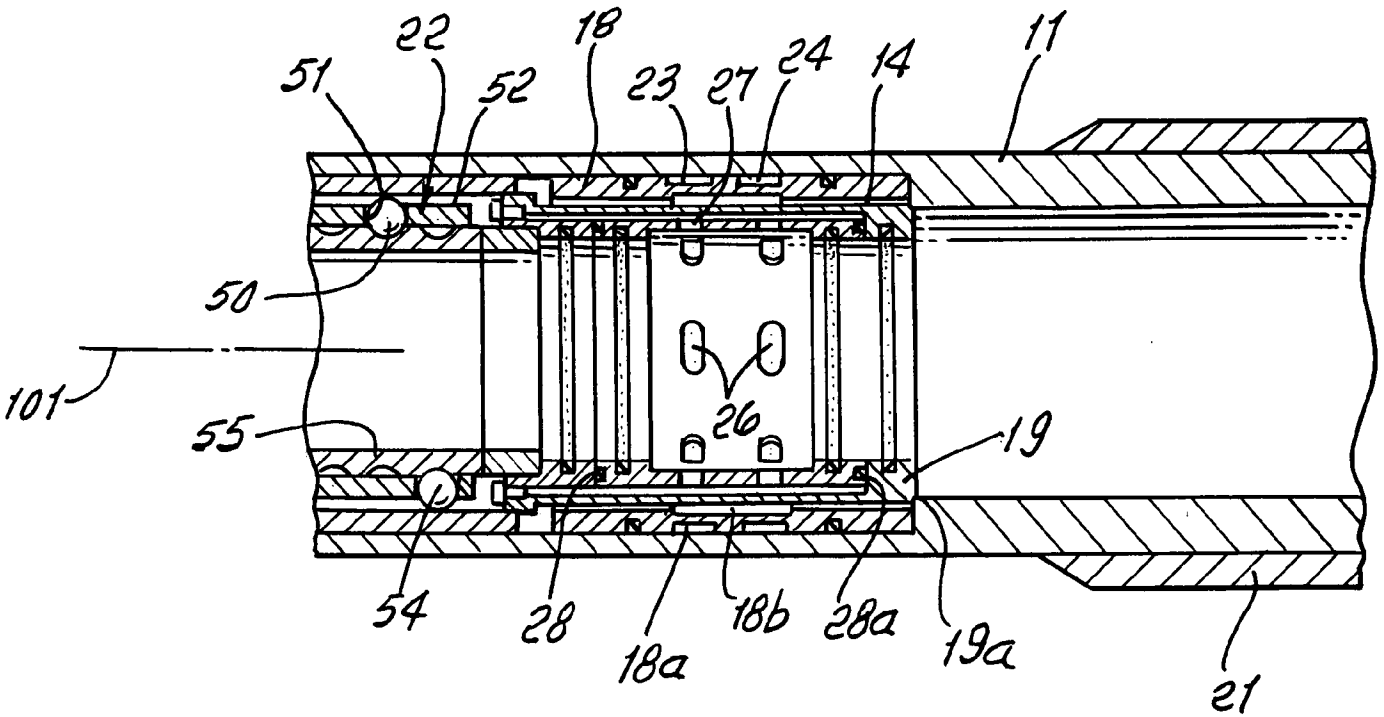

FIG. 3*b* shows a longitudinal cross-section of the rotary joint for drilling fluid of the present invention with the central rotating mandrel removed.

Figure 4:
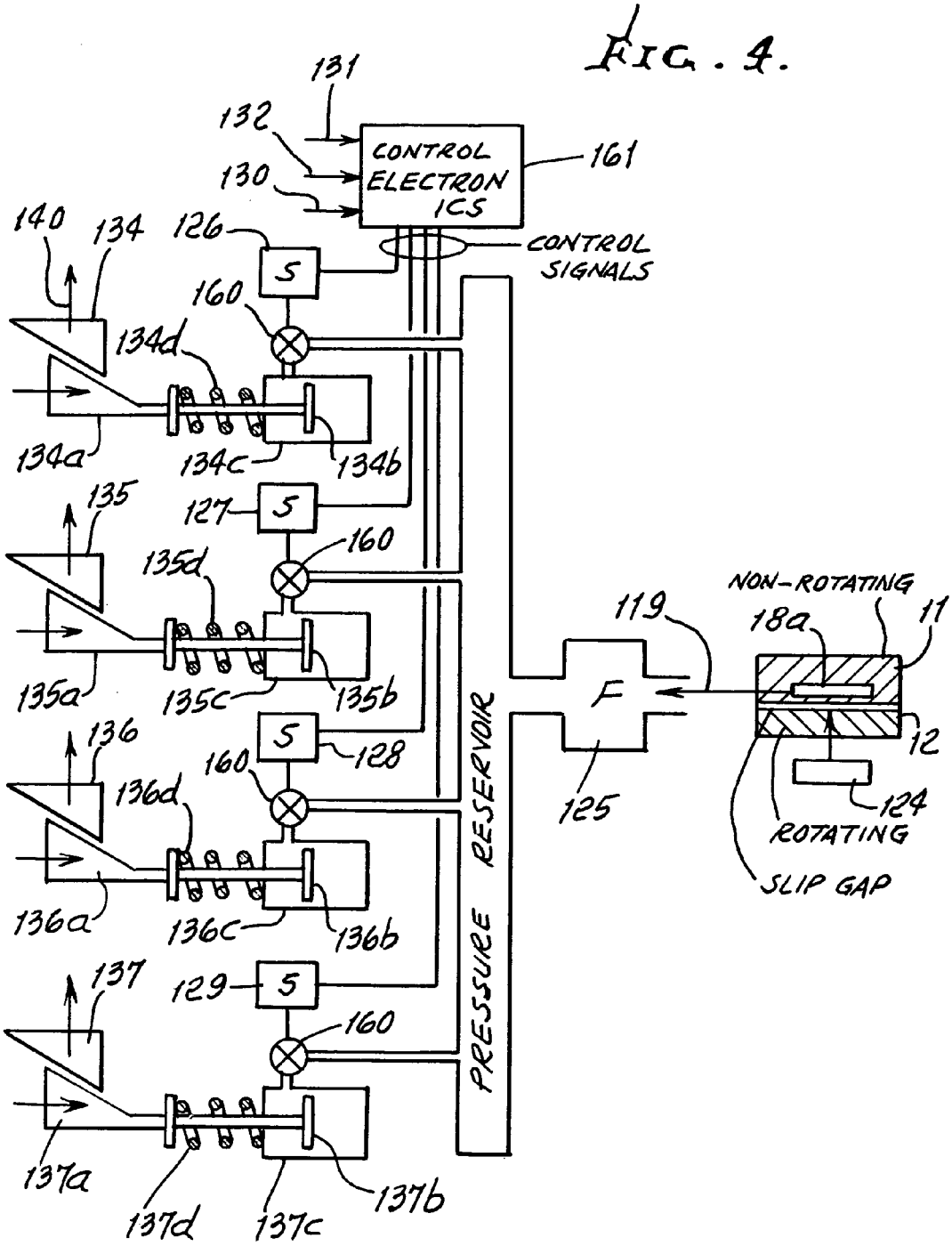

FIG. 4 is a system control diagram.

DETAILED DESCRIPTION

FIG. 1 shows diagrammatically a typical rotary drilling installation of a type in which the present invention may be used. The bottom hole assembly includes a drill bit 1 connected to the lower end of drill string 2 which is rotatably driven from the surface by a rotary table 3 on a drilling platform 4. A suitable drilling fluid, generally referred to as mud, is pumped downward through the interior of the drill string 2 to assist in drilling and to flush cuttings from the drilling operation back to the surface in the annular hole 2*a* outside of the drill string 2. The rotary table is driven by a drive motor 5. Raising and lowering of the drill string, and application of weight-on-bit, is under the control of draw works indicated diagrammatically at 6.

The bottom hole assembly includes a bearing section 8 for attachment to the drill string 2, and that permits rotary motion between the drill string 2 and the steerable section 9. The outer surface 10 of the steerable section 9 may be held in a fixed rotational direction or it may be allowed to rotate slowly as the drill sting penetrates into the earth. Internal to the steerable section, a rotary element or elements connect the drill string 2 to the drill bit 1. A side-force exerting mechanism 9*a* is provided in or at the steerable section 9, that provides the side force that enables drilling to progress in any desired direction. The direction, in space, of the side force maybe controlled by elements within the steerable section 9. Mechanism 9*a* may engage the bore of hole 2*a*.

FIG. 2 shows a longitudinal cross-section of a portion of a steerable rotary drilling apparatus in simplified schematic form. An outer housing 11 contains the direction control mechanisms and various sensors and control electronics indicated schematically at 100. Steerable rotary drilling apparatus is provided in which the direction control mechanisms are operated by pressure from drilling fluids. A rotating mandrel 12 is connected at one end to the drill string 2 above the steerable apparatus and at the outer end to the drill bit. As such, the rotating mandrel 12 rotates at the same angular rate about the longitudinal axis 101 as the drill string and drill bit. Annular gap 14 extending radially provides clearance between rotating mandrel 12 and the outer housing 11. The outer housing 11 may be stabilized to near zero angular rate of rotation or it may be allowed to rotate slowly, about the longitudinal axis.

Drilling fluid flows downwardly from the drill string through the interior bore 13 of the rotating mandrel 12. Cavity or plenum 16 shown in the outer housing 11 contains or connects as at 102 to apparatus 100 operable by the pressurized drilling fluid from the interior bore 13 that is communicated by passage, or passages, 15 in the rotating mandrel and passage, and/or passages 17 in the outer housing 11. The means for providing this radial fluid conduction path should provide a reasonably good axial seal to prevent excessive fluid loss along the radial gap 14, to the annulus in the well, whereby a small radial gap 14 is desired. The drilling fluid rising in the annulus, for containing drill bit cuttings, may contain sand or other matter that would tend to create wear or jamming of the relatively rotating parts if it entered gap 14, from the annulus and drilling fluid from the string bore flushes the gap. There may be relatively high forces placed on the mandrel 12 and/or the outer housing 11. The desired close fit on radial gap 14 should be maintained in spite of various tolerances on the parts of the mandrel 12 and the outer housing 11, to leak fluid to the annulus and also to lubricate the relatively moving elements.

FIG. 3*a* shows a longitudinal cross-section of the rotary joint for drilling fluid of the present invention with the central rotating mandrel 12 in place. Where elements in FIG. 3*a* are the same as or equivalent to corresponding elements in FIG. 2, the same identifying numbers are used. Outer housing 11 is a portion of the outer housing for a steerable rotary drilling apparatus. A stabilizer blade 21 is shown on the exterior of the outer housing 11. Opposite end portions 12*a* and 12*b* of the mandrel are interior to the steerable rotary drilling apparatus. Portion 12*a* is the lower portion of the rotating mandrel and is connected to a drill bit 104 (shown schematically) at the lower end of the drill string. Portion 12*b* is the upper portion of the rotating mandrel and is connected to the drill string 2. The rotating mandrel 12 is rotated from the surface to operate the drill bit. The interior bore 13 of the rotating mandrel 12 conducts drilling fluid pumped from the surface downwardly and through the drill bit. An opening or openings 15*a* in the rotating mandrel 12 permits a portion of the drilling fluid to flow radially outward through elements of the rotary fluid joint 19, 20 and into the stationary element 18 of the fluid joint. Discussion of the sleeve elements 18, 19, 20 will be provided in the discussion of FIG. 3*b* below. The portion of the drilling fluid that exits the rotating mandrel 12*b* at opening 15*a* is then conducted by passages 18*a*, 18*b*, etc., from stationary element 18 to locations in the outer housing 11 for use as needed, as at 100 in FIG. 2.

Sleeve elements 19, 20 of the rotary fluid joint rotate with the inner rotating mandrel 12*a*, 12*b*. Element 18 of the rotary fluid joint is fixed stationary in the outer housing 11 which may be inhibited against rotation by frictional engagement with the wellbore; however, housing 11 advances downwardly in the well with the mandrel, element 19 engaging 11, as at shoulder 19*a* for this purpose. Relative rotational motion about the longitudinal axis of the inner mandrel 12 with respect to the outer housing 11 takes place at the radial gap 14, formed between 18 and rotating sleeve element 19. An example of a bearing assembly 22 that is part of the steerable rotary drilling apparatus is as shown, and includes annularly spaced balls 50 in openings 21 formed by a sleeve 52 projecting in space 53 located endwise of 18–20. A ball race 54 is formed by a sleeve 55 fitting about mandrel end portion 12*b*.

FIG. 3*b* shows a longitudinal cross-section of the rotary joint for drilling fluid, with the central rotating mandrel 12 removed. The three principal elements of the rotary fluid joint are the three coaxial cylindricals or sleeves. These are a floating interior element 20 that is fixedly attached to the rotating mandrel 12, an intermediate sleeve element 19 and an outer sleeve element 18 that is fixedly attached to the outer housing 11. The intermediate element 19 rotates about its longitudinal axis with the floating interior element 20, and is constrained on its outer surface by the interior bore of the outer element 18. The radial gap 14 between intermediate element 19 and outer element 18 may be sized as desired to control axial leakage of drilling fluid out along the longitudinal direction of the gap, as referred to.

Typically dimensions found useful are for the radial gap 14 to be in the range of a few thousandths of an inch, for example about 0.001 to 0.008 inch. An important feature of the rotary fluid joint is the inclusion of flexible connections 28 and 28*a* at opposite ends of floating element 20, to connect the floating element 20 to the intermediate element 19. In FIG. 3*b*, the flexible connections 28 and 28*a* are provided by O-rings at opposite ends of the floating sleeve element 20. These elastic elements 28 and 28*a* permit the floating element 20 (which is fixedly attached to the rotating mandrel 12*b*) to move both angularly about axes perpendicular to the longitudinal axis, and radially, without imposing excess loads at the radial gap 14 that would cause binding or excess wear. A number of openings 26 in the floating element 20 and similar holes 27 in the intermediate element 19 are provided to permit drilling fluid to flow from the interior of the rotating mandrel to circumferential gap 14 and then to gaps or plenum 23, 24 for distribution within the outer housing 11, as referred to. In a preferred embodiment, the rotary fluid joint is made up of the three elements as described above. In practice, the floating element 20 can be machined or formed as a portion of the rotating mandrel 12*a*, 12*b* and the outer element 18 can be machined or formed as a portion of the outer housing 11. Of importance are the provision of an intermediate element 19 that can provide a good fit to the outer element 18 and a flexible connection to the floating element 20.

It will be understood that the sequence of elements from floating to intermediate to outer can be reversed so that the floating sleeve or ring is on the outside, the intermediate sleeve or ring is still in the middle connected by a flexible connection to the floating element and constrained by an inner element. This equivalent arrangement maintains the floating element, and intermediate element of the present invention, in position for use as described.

Further, and referring also to FIG. 3*aa*, drilling fluid supplied to the bore 13 of mandrel 12 flows via port 15*a* to axially elongated first annular reservoir or passage 20*a* sunk in bore 20*b* of sleeve 20, which rotate with 12. O-rings 80 and 81 seal off bore 20*b* and the mandrel periphery 12*a*, at opposite ends of first reservoir 20*a*. Shoulders 82 and 83 retain opposite ends of 20 in position on the mandrel.

Drilling fluid flow (or is supplied) from first reservoir 20*a*, via radial passages 20*e* in 20 to axially elongated second reservoir or passage 19*a* sunk in bore 19*b* of sleeve 19, O-rings 84 and 85 sealing off between 19 and 20, at opposite ends of reservoir 19*a*. Sleeves 19 and 20 are interconnected at 86, to rotate together.

Drilling fluid then flows (or is supplied via radial passages 19*e* in 19 to axially elongated third reservoir or passage 18*a* sunk in bore 18*b* of axially elongated non-rotary sleeve 18. Fluid is enabled to slowly leak from elongated plenum or reservoir 18*a* to the exterior, via the cylindrical elongated clearance or gaps formed at 18*b* between the bore 18*d* of non-rotating sleeve 18 and the cylindrical outer surface 19*f* of 19, gap 18*b* being in direct endwise communication with the third reservoir 18*a*.

From third elongated reservoir 18*a*, fluid flows via passage or passages 18*c* in 18 to fourth elongated reservoir 19*q* sunk in the outer surface of 18. From that fourth reservoir, or plenum, pressurized fluid flows via passages 119 to valves 160 (seen in FIG. 4 schematic), for controlled application to pistons operable to control positioning of directional drilling steering pads.

It will be noted that the several (first through fourth) elongated reservoirs or plenums serve the function of substantially reducing or eliminating perturbations or pressured drilling fluid between the mandrel bore 13 (where such perturbations are at a maximum) and the passage or passages 119, leading to the valves 160, where pressure is desirably at or near a steady valve, for application to the pistons that actuate the steering pads. Such plenums are provided in a minimum space in the well; and the small sized passages 20*e*, 19*e* and 18*c* operate in series with such plenums to filter out drilling mud pressure fluctuations.

A filter screen 124 at the inlet side of mud flow via the mandrel to plenum 20*a* operates to screen out large particles from the flow; and a "fines" filter may be employed at 125 seen in FIG. 4, to remove fine particles from the flow to the valves.

In FIG. 4, four valves 160 are controlled by solenoids 126–129. The controller 161 for the solenoids receives inputs from sensors including accelerometers at 130, and/or magnetometers at 131, and/or gyroscopes at 132, those instruments for example carried by the housing 11 to sense housing position and/or movement in the well, in order that the four force exerting pads 134–137 may be controllably and differentially actuated to exert force against the well bore, to control drilling direction. The pads may be positioned at successive 90° azimuth amples about the housing axis. Pad actuators include camming elements 134*a*–137*a* moved linearly as by pistons 134*b*–137*b* movable linearly in cylinder 134*c*–137*c*, in response to controlled valve displacements to deliver fluid pressure to the pistons. Piston displacements may be feed back controlled, as by sensors sensing piston displacement, for accuracy of pad displacement. Controllable exhausting of fluid pressure to the pistons results in retraction of the pistons effected by compression springs 134*d*–137*d* that resist piston movement in directions 140 to displace the pads toward the wellbore.

We claim:

1. For use in a wellbore containing a rotary drill string and a drill bit, the combination comprising, a) a rotary mandrel containing a through opening to pass drilling fluid downwardly from the interior of the drill string, and toward the bit, b) a non-rotary housing extending about the mandrel, c) a plenum or plenums in the housing in communication with the interior of the mandrel through an opening to receive fluid pressure used to actuate included means associated with directional control of drilling activity in the well, d) and a controlled fluid gap proximate the housing, to slowly leak drilling fluid to the annulus outside the string.

2. The combination of claim 1 wherein there are side passages in the mandrel and in the housing to pass said fluid pressure from the mandrel through the opening to said plenum.

3. The combination of claim 1 wherein said included means comprises a steering element to be displaced by fluid pressure from the plenum, for directionally steering the bit, during drilling.

4. The combination of claim 1 including a first sleeve received in the housing and defining at least part of said plenum, outwardly of said mandrel, said sleeve being non-rotating.

5. The combination of claim 4 including a second and floating sleeve received in the housing and attached to the mandrel to rotate therewith, said first sleeve extending about at least part of the second sleeve, and a third and intermediate sleeve located between the first and second sleeves, the second and third sleeves having flexible interconnection allowing relation movement therebetween about an axis normal to the longitudinal axis defined by the housing, and there being openings in the second and third sleeves to pass fluid pressure from the mandrel to said plenum.

6. The combination of claim 5 wherein the flexible interconnection is defined by O-rings at opposite ends of the second sleeve and engaging said second and third sleeves.

7. The combination of claim 5 including a radial gap between the first and third sleeves to pass fluid leakage from the plenum, and having a size controlled by floating movement of the second sleeve.

8. The combination of claim 5 wherein the first sleeve is part of the housing.

9. The combination of claim 5 wherein the second sleeve is part of the mandrel.

10. The combination of claim 8 wherein the second sleeve is part of the mandrel.

11. The combination of claim 1 including said drill string supporting the mandrel and housing in the wellbore.

12. The combination of claim 1 including the drill bit connected to rotate with the mandrel.

13. The combination of claim 1 wherein there are a plurality of said plenums arranged to successively receive fluid pressure and to attenuate fluid pressure pulsations associated with movement of drilling fluid in the drill string.

14. The combination of claim 13 wherein said plenums are elongated in the direction of mandrel elongation.

15. The combination of claim 1 including said means that includes i) pads carried by housing structure for displacement toward the wellbore to exert pressure on the bore, ii) piston actuated structure to displace said pads, iii) valves operatively connected with said pistons to control application of said fluid pressure via the plenum or plenums, to the pistons, and iv) solenoids to control said valves to accurately control pad displacement, thereby to control directional drilling.

16. A rotary fluid joint apparatus for conducting fluid from the interior of a rotating element to an exterior element comprising:

a) an interior floating element for connection to said interior rotating element, b) an intermediate element flexibly-connected to said interior floating element constrained to rotate in a bore of an outer element, c) a flexible coupling mechanism for connecting said intermediate element to said floating element, d) said outer element connected to said exterior element which is characterized by one of the following: i) non-rotating, or ii) slowly rotating, and e) openings in said floating element, said intermediate element and said outer element to permit radial flow of fluid from the interior of said rotating element to said exterior non-rotating or slowly-rotating element.

17. The apparatus of claim 16 wherein said interior floating element is configured as a part of said interior rotating element.

18. The apparatus of claim 16 wherein said outer element is configured as a part of said exterior non-rotating or slowly-rotating element.

19. The apparatus of claim 16 wherein said flexible coupling mechanism comprises an O-ring at each end of said floating element.

20. The apparatus of claim 16 wherein a controlled radial gap is provided between said intermediate element and said outer element.

21. The apparatus of claim 16 in which the sequence of elements from floating to intermediate to outer is reversed so that the floating ring is on the outside, the intermediate ring remaining in the middle connected by a flexible connection to the floating element and constrained by an inner element.

22. Directional drilling apparatus for use in drilling of a well, and having first means movable to exert pressure on the wellbore, said apparatus comprising a) second means for conducting pressure exerted by drilling fluid to be utilized by said first means, b) said second means having a path that crosses between rotating and non-rotating elements, c) there being at least one fluid reservoir communication with said path, said reservoir associated with a non-rotating element.

23. The apparatus of claim 22 wherein there are multiple of said reservoirs.

24. The apparatus of claim 23 wherein a rotating element includes a mandrel, and a non-rotating element includes a housing within which the mandrel rotates, said reservoirs located between the mandrel and an outer surface defined by the housing.

25. The apparatus of claim 22 including solenoid controlled valves in said path, to control fluid pressure application operable to selectively move pressure exerting pads defined by said first means.

* * * * *